US007017568B1

(12) United States Patent
Smith

(10) Patent No.: US 7,017,568 B1
(45) Date of Patent: Mar. 28, 2006

(54) PNEUMATIC COCKING DEVICE

(76) Inventor: Douglas Lane Smith, 9375 N. Hampshire Dr., Tucson, AZ (US) 85742

( * ) Notice: Subject to any disclaimer, the term of this patent is extended or adjusted under 35 U.S.C. 154(b) by 0 days.

(21) Appl. No.: 10/429,408

(22) Filed: May 6, 2003

(51) Int. Cl.
*F41B 5/12* (2006.01)

(52) U.S. Cl. ..... 124/25
(58) Field of Classification Search ..... 124/23.1, 124/25
See application file for complete search history.

(56) References Cited

U.S. PATENT DOCUMENTS

| | | | | |
|---|---|---|---|---|
| 4,603,676 | A * | 8/1986 | Luoma | 124/25 |
| 4,719,897 | A * | 1/1988 | Gaudreau | 124/25 |
| 5,445,139 | A * | 8/1995 | Bybee | 124/23.1 |
| 5,749,348 | A * | 5/1998 | Oviedo-Reyes | 124/25 |
| 5,823,172 | A * | 10/1998 | Suggitt | 124/25 |
| 6,095,128 | A * | 8/2000 | Bednar | 124/25 |
| 6,286,496 | B1 * | 9/2001 | Bednar | 124/25 |

OTHER PUBLICATIONS

Catalog from Barnett Crossbow Company, Undated.*
Catalog from Genuine Innovations Inc., 2003/2004.*

* cited by examiner

*Primary Examiner*—John A. Ricci
(74) *Attorney, Agent, or Firm*—J. Marc Edwards

(57) ABSTRACT

The present invention relates generally to crossbow bowstring drawing mechanisms, also called cocking mechanisms in the art. More particularly, the present invention relates to a crossbow bowstring drawing mechanism that is integrated into a crossbow. The mechanism primarily consists of a pneumatically actuated piston and cylinder assembly, a compressed gas dispenser, and a string pick up arm. An after-the-fact bolt-on kit is also intended to be within the scope of this application allowing retrofit to existing bows not currently outfitted with this cocking feature. The bowstring cocking mechanism may utilize an internal power source such as compressed carbon dioxide ($CO_2$) cartridge, or a plurality of cartridges to actuate the pneumatics that are part of the cocking mechanism on demand. Such actuation draws a bowstring from the un-cocked position to the cocked position. Likewise, such actuation will equally allow a controlled dry-fire, allowing the bowstring to be released from the cocked position to the un-cocked position; the pneumatics acting as a system damper, preventing damage to the bow limbs.

8 Claims, 3 Drawing Sheets

PNEUMATIC COCKING DEVICE

CROSS REFERENCE TO RELATED APPLICATIONS

Not Applicable.

FEDERALLY SPONSORED RESEARCH

Not Applicable.

SEQUENCE APPENDAGES

Not Applicable.

FIELD OF THE INVENTION

The present invention relates generally to crossbow bowstring drawing mechanisms, also called cocking mechanisms in the art. More particularly, the present invention relates to a crossbow bowstring drawing mechanism that is integrated into a crossbow. An after-the-fact bolt-on kit is also intended to be within the scope of this application allowing retrofit to existing bows not currently outfitted with this cocking feature. The bowstring cocking mechanism may utilize an internal power source such as a compressed carbon dioxide ($CO_2$) cartridge, or a plurality of cartridges to actuate the pneumatics that are part of the cocking mechanism on demand. Such actuation will draw a bowstring from the un-cocked position to the cocked position. Likewise, such actuation will equally allow a controlled dry fire, allowing the bowstring to be released from the cocked position to the un-cocked position; the pneumatics acting as a system damper. The controlled dry fire will prevent damage to the bow limbs as a dry fire (to release a cocked bowstring without a projectile) is highly discouraged as stated in bow manufacturer's owner's manuals and will void warranties.

Most crossbows in the art are rated by their draw weight, typically dimensioned in pounds. This is the effective force required to draw a bowstring from an un-cocked position to the cocked position. On the average, most professional-grade crossbows inherently have a 125 to 200 pound draw weight.

Drawing a crossbow bowstring has been accomplished in a variety of ways. The most common method of drawing a crossbow bowstring is to manually grab the bowstring with both hands and draw to the cocked position. The crossbow orientation for doing this is to place the fore end of the bow to the ground. Mounted to the bow front end is a device commonly called a stirrup, usually made of steel or aluminum. The stirrup is used for holding the crossbow with one or two feet while cocking; and is usually in the shape of a "D" or "T" and is sometimes made from webbing or rope. Another nearly identical method of cocking a crossbow is to grab the bowstring with both hands and then step into the stirrup without bending over. The archer then steps down, in turn, drawing the bowstring into the cocked position.

Alternatively, the archer temporarily attaches to the bowstring two hooks that grasp on each side of the flight track. The flight track comprises the main longitudinal spar or frame in a crossbow. Ropes are attached to these hooks and the archer pushes down with a foot or both feet and equally and oppositely pulls up on the two ropes, one in each hand, thus drawing the bowstring to the cocked position to be retained by the sear mechanism. On most traditional systems then, the archer removes the two hooks with attached ropes from the bowstring and retains these in a separate bag or pocket.

Some potential handicaps for this cocking method and the following cocking methods are as follows. If an archer has a less than healthy back or simply limited physical strength, it may be impossible for one to draw the bowstring. If an archer is using a tree stand, it may be very challenging, thus unsafe to draw a bowstring on such a tiny platform. Adverse weather conditions such as severe wet and cold conditions dictate that the archer use heavy gloves as well as the equipment being potentially wet or icy introduce further challenges. Additionally, in severe cold conditions, it may be nearly impossible to draw the string with cold or gloved fingers or grasp the ropes in ones hands that attach to the hooks for drawing. Even if environmental conditions are excellent and the archer is in adequate physical shape, it takes time to set up such cocking mechanisms and then adequately stow such systems when not in use.

In a very historical sense as well as is used in modern day is a cocking device called the goat's foot. Basically it is a two-piece hinged cocking lever designed to pull a bowstring to the cocked position. A longer cocking lever will impart a higher mechanical advantage by allowing a greater moment arm. In the event that the archer slips while using such a device, a goat's foot can be potentially dangerous.

More recently, winch-type-cranking mechanisms have been introduced to the archery industry. Some exhibit minimal mechanical advantages and others exhibit huge mechanical advantages. The models with low mechanical advantage require a greater force to turn the crank handle but draw the bowstring fast. Likewise, the high mechanical advantage winch mechanisms require little effort to turn the crank handle but draw the bowstring slowly. Some models have the option of part or the entire winch being removed when not in use and are stowed in a separate bag. Other models are large and bulky and permanently mount on the crossbow stock. Yet, other models are more tidily integrated into the crossbow such as by being built-in to the stock. All of these winch-type cranking mechanism will and do work but still take time and effort to use. Additionally, these winch-type cranking mechanisms offer the capacity to un-cock a bow in the event of a necessary dry fire but as well, take time to operate.

A more recent innovation for cocking a crossbow utilizes a linkage system, typically a five-bar linkage, to span the bowstring. Located on the foremost part of the flight track is a string pick up. When an archer actuates the cocking linkage, the string pick up translates along the flight track, catching the bowstring, thereby cocking the bow. The benefit of using a string pick up is that the pick up evenly loads the bow limbs, reducing string wear and insuring exact centering of the string when cocking. When the limbs are loaded even slightly unevenly, the resulting arrow flight is predictably erratic. It should have one degree of freedom, that being longitudinal. Operatively connected to the sled are a series of links and pivots used to transfer a folding stock to a linear motion on the string pick up; thus a cocking device. The length of the stock determines the lever moment arm. This design looks and probably works well but should an archer slip during a cocking or un-cocking procedure, it seems conceivable that something could be pinched in the mechanism, such as clothing or worse, a body part; or upon slipping, the crossbow itself could become a projectile.

None of the known arrangements have provided a system which easily and repeatably enables cocking and un-cocking of the crossbow bowstring. The use of a sled-type mechanism conceivably seems appropriate thereby providing substantially equal limb loading upon cocking but the actuation force originates from a much different source in this invention. It is preferable to integrate this concept into a bow prior to manufacture but it is also desirable to be able to effectively retrofit an existing crossbow with this cocking and un-cocking mechanism.

SUMMARY OF THE INVENTION

The invention relates to a cocking and de-cocking device for use in any machine that utilizes stored potential energy as is typically found in archery equipment, particularly crossbows. It is an object of the present invention to disclose not only the preferred hardware necessary to cock and un-cock a piece of equipment but additionally describe a method of accomplishing the same.

Generally, this cocking device uses a pneumatically actuated cylinder or cylinders to do the work of drawing a crossbow bowstring from the at-rest, un-cocked position to the cocked position. The crossbow term for the physical act of drawing a bowstring is called cocking and the instrument used to accomplish this work is typically called the cocking device. Likewise, the same pneumatic cylinder or cylinders work equally well when an archer desires to controllably release the bowstring from a cocked position to an un-cocked position.

The preferred embodiment of the present invention utilizes a single pneumatic cylinder integrated from the design stage into a crossbow stock. The string pick up arm is longitudinally mounted inside a crossbow bolt channel sometimes also called the arrow channel, and is preferably in-line with the single pneumatic cylinder. The flight track typically has a void in current designs, allowing clearance for one of the (usually) three arrow fletchings. Located further down within the flight track void is a linear track that the string pick up arm translates along as a linear guide, allowing one degree of freedom. This pneumatic cylinder and string pick up assembly run substantially the length of the crossbow. The following detailed description and figures will adequately detail the preferred pneumatic cylinder proximity and its operative connection to the soon-to-be-described operatively connected string pick up arm.

Located as part of the pick up arm assembly and protruding above the flight track are one or more string contacts, preferably comprising a surface suitable for contact with a bowstring. These one or more protruding contacts act as the contacting interface between the bowstring and the string pick up arm which is of course, operatively attached to the pneumatic actuated piston.

In the preferred embodiment, a rigid shaft has its foremost distal end attached to the string pick up arm just below the bolt channel surface, protruding through the afore-mentioned flight track void. This makes for mechanical linkage simplicity, a clean appearance, and keeps some of the moving parts out of the way (contained within a hollow bolt channel) for safety and functional ergonomics. The opposite distal end of the rigid shaft rigidly attaches to the pneumatic piston. Said piston is allowed to translate within the pneumatic cylinder by changes in cylinder pressures as will be discussed below or by limb forces when employed as an un-cocking damper device.

Elaborating on the pneumatic piston and cylinder dimensions with respect to diameter and length, it is an object of the invention to allow for a range in dimensions. Just some of the factors that will affect the final design of this cylinder assembly include: bow draw weight including cam let-offs or lack of, space limitations, source gas volumes and initial pressures and draw length from un-cocked to the cocked position.

In another embodiment, operatively connecting the piston to the string pick up arm is accomplished through a cable, allowing for the pneumatic cylinder to be out-of-alignment with the string pick up if design constraints require. It is conceivable that out-of-alignment means behind the string pick up arm or underneath it, parallel to or not parallel to or a combination of any. Reasons for this may include the ability to easily fold a stock for storage or transport and a cable allows for the needed flexibility for bow tear-down. Additionally, ergonomic design constraints may dictate that the pneumatic cylinder assembly be placed in a non in-line orientation with the string pick up. Similarly, pneumatic cylinders of differing sizes are intended to be within the scope of this invention as design parameters may dictate cylinder length, diameter, or other factors such as alternative locating.

The preferable source of potential energy for this pneumatically actuated system comes from readily-availably compressed gas $CO_2$ cartridges. One major manufacturer of such cartridges is a company called iSi North America, Inc., although other manufacturers exist. One skilled in the art realizes that such compressed gas cartridges are commercially available with a variety of volumes and preferably would utilize a 12-gram (gas weight) cartridge as a minimum size. Preferably, the common 16-gram cartridge allows repeated cocking capabilities (bowstring draws) from the potential energy contained in a single cartridge. A skilled pneumatics artisan also realizes that larger volume cartridges or a plurality of compressed gas cartridges, fluidly connected in series or in parallel, allow for additional cocking cycles between cartridge change-outs. Tiny cartridges that only allow enough compressed gas for one draw are already commercially available and a skilled artisan would have no difficulties integrating such a constraint into this system.

The fluid connections of this system are now discussed. For simplicity reasons, only one compressed gas cartridge is harnessed in this example. Methods for harnessing compressed gas cartridges are well established. One company located in America that has refined the art of harnessing high-pressure compressed gas cartridges is called Innovations In Cycling, Inc. located in Tucson, Ariz. This company particularly engineers and manufactures controllable gas-release dispensers used primarily to controllably inflate articles of manufacture and similar. A cartridge is punctured, thus harnessed, and the cartridge pressure is contained in equilibrium between the cartridge and the pneumatic trigger. The figures and detailed description will adequately detail this paragraph. Inventor prefers to segregate the pneumatic trigger from the firing trigger that actuates the bowstring releasing sear mostly because, in practice, the two are used at different times. The pneumatic dispenser is then plumbed to the pneumatic cylinder; such that the gas can do work by displacing the piston assembly. Again, the figures will clearly detail the preferred placement.

The method employed to draw the bowstring involves an archer actuating the pneumatic trigger, thus introducing compressed gas into the pneumatic cylinder enabling the piston to do work on the operatively connected string pick up arm. The string pick up arm contacts the bowstring from the un-cocked position and draws the bowstring to the cocked position along the flight track in a smooth, controlled manner. Once the bowstring reaches the retaining latch mechanism, the pneumatics are not needed and the arm is able to drop out of the way of the bowstring by the insertion of an arrow physically pushing the biased-up pick up arm to the down position. The important principle being that the string pick up arm is clear from interfering or crashing with any dynamic situation string paths incurred upon firing the bow. In the preferred embodiment, the guided string pick up arm is integrated into a linear track located preferably underneath the flight track, protruding through the flight track fletching void and utilized a biased up, foldable fork mechanism. The following figures show this feature.

Likewise, if an archer already has the bowstring retained in a cocked position and desires to un-cock the bowstring without firing a bolt (arrow), this invention accomplishes this function equally well. Both of the afore-mentioned embodiments of string pick up arm, folding and non-folding, will be elaborated as follows: In one embodiment, the pneumatic trigger is actuated to draw the string pick up arm into contact with the cocked bowstring. It is intended, by design, to allow the string pick up arm to travel just beyond the retaining latch. Now the archer need only release the string with the firing trigger, allowing the string force to be imparted on the string pick up arm and hence, the operatively connected pneumatics. An exit-gas restrictor slows the let-off rate, damping the system, thereby preserving the limbs from a dry-fire. In another embodiment, the string pick up arm resides just in front of the string retaining sear, having been placed there from the last bowstring cocking operation. The folding string pick up arm is biased in the up position and pivots about a pin located on the string pick up lower assembly. In practice, the string pick up is displaced down, at least flush with the flight track by the insertion of a bolt (arrow). Most current art bows utilize a cantilevered spring to retain the bolt in position with respect to string contact and correct orientation with the flight track, even if the bow is randomly handled such as by carrying. In the preferred embodiment, the cantilevered retaining spring acts not only to hold the bolt in place when the bow is cocked but additionally to push the string pick up arm out of the way of the string flight path.

Also in the preferred embodiment, a side bolt or lever arm protruding out of the crossbow for hand actuation is used to manually move the pick up arm assembly without the need to use compressed gas. The archer manually draws the string pick arm to the bowstring and releases the bowstring with the firing mechanism. There is no need for the archer to grab the side bolt upon un-cocking because the displaced piston volume escaping as the bow limbs pull on the mechanism is restricted, retarding the release rate of the limbs, controllably letting-off the bowstring from the cocked to un-cocked position. Or after firing a bolt, the string pick up arm may be located near the string latch and the archer desires to move the pick up arm forward by use of the side bolt. Typically, static friction or stiction in the piston to cylinder assembly prevents the whole pneumatic and string pick up arm assembly from sloppily moving around such as in handling the bow in differing orientations.

DETAILED DESCRIPTION

Figure 1:
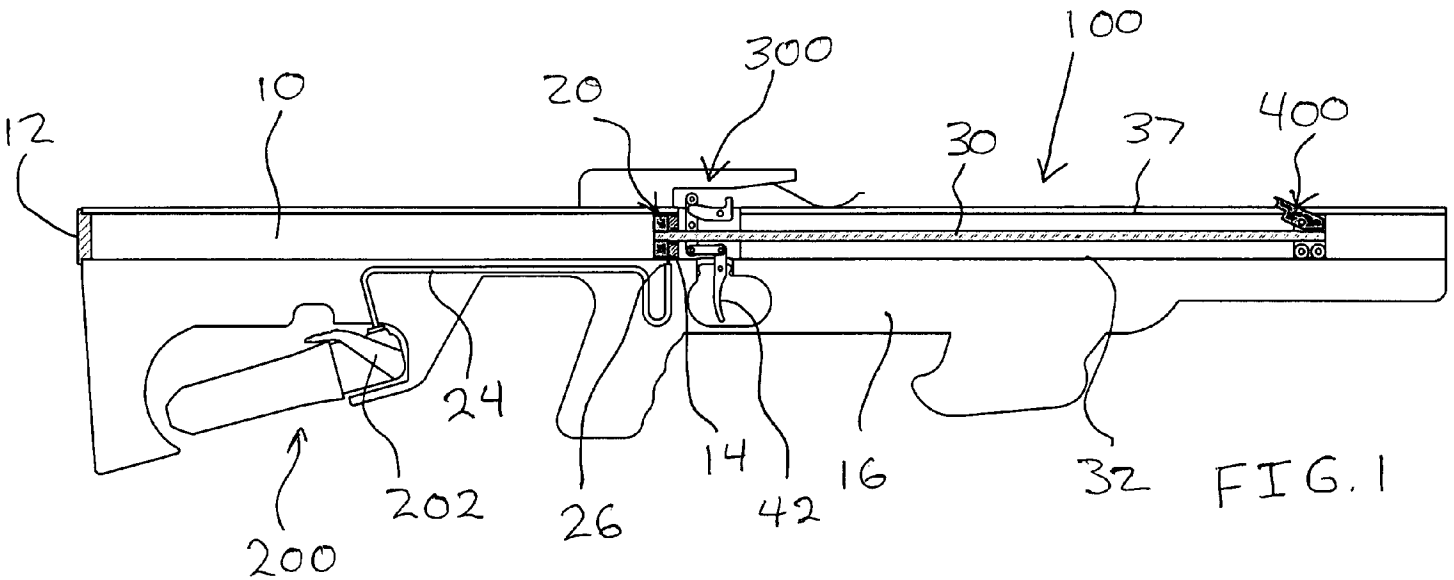
FIG. 1 shows a side sectional view of the preferred crossbow embodiment, in-line piston, cylinder, and bowstring drawing attachment, utilizing an off-the-shelf proven design compressed gas cartridge dispenser integrated into the assembly. Note: crossbow limbs and bowstring are not shown.

In the following detailed description of preferred embodiments of the present invention, reference is made to the accompanying drawings that, in conjunction with this detailed description, illustrate a crossbow cocking and un-cocking mechanism.

Referring now to the drawings, like-referenced elements indicate corresponding elements throughout the several views or embodiments. Attention is first directed to FIG. 1 which illustrates the preferred embodiment, in-line pneumatically-actuated crossbow 100 shown in a complete side sectional view. For illustration simplification purposes, the bow limbs and bowstring have been omitted from this and all figures.

FIG. 1, showing the complete invention, preferably orients the pneumatic cylinder 10, piston assembly 20, connecting rod 30, and operatively connected pick up arm assembly 400 all in an in-line layout.

Pneumatic cylinder 10 is preferably mounted in the crossbow stock 16 and completely housed, thus supported by the surrounding stock 16. Near the crossbow center, pneumatic cylinder 10 effectively terminates past forward end cap 14. Residing within pneumatic cylinder 10 is piston assembly 20. Piston assembly 20 circumferentially seals in cylinder 10 and is allowed to freely translate from approximate crossbow center, at forward end cap 14, all the way to bow aft end, where aft end cap 12 is located.

Most visible in FIG. 1 is the piston assembly 20 comprises piston 21, and at least one circumferential sealing ring 22 such as an o-ring seal. The preferred embodiment utilizes two circumferential sealing rings shown by 22 and 22'. Threaded connection 23 between connecting rod 30 and piston 21 mechanically connects these two parts.

Connecting rod 30 operatively connects piston assembly 20 to pick up arm assembly 400, shown at 46. At pneumatic cylinder 10 fore-most end, contained within forward end cap 14, also is a connecting rod guide 31. Forward end cap 14 allows connecting rod 30 to linearly translate past its seal 27, preferably an o-ring situated in an o-ring groove, yet prevents pressure losses from within the pneumatic cylinder 10. The outer circumference of forward end cap 14 seals the pneumatic cylinder 10 by o-ring seal 29, also maintained in an o-ring groove.

Pick up arm assembly 400 (FIGS. 1,2,3) rigidly connects, at 46, to connecting rod 30. Pick up frame 42 is allowed to translate along pick up arm track 32, supported by one or more rollers as at 44. Alternatively, any type of a supportive linear bearing is intended to be within the scope of this invention.

Figure 2:
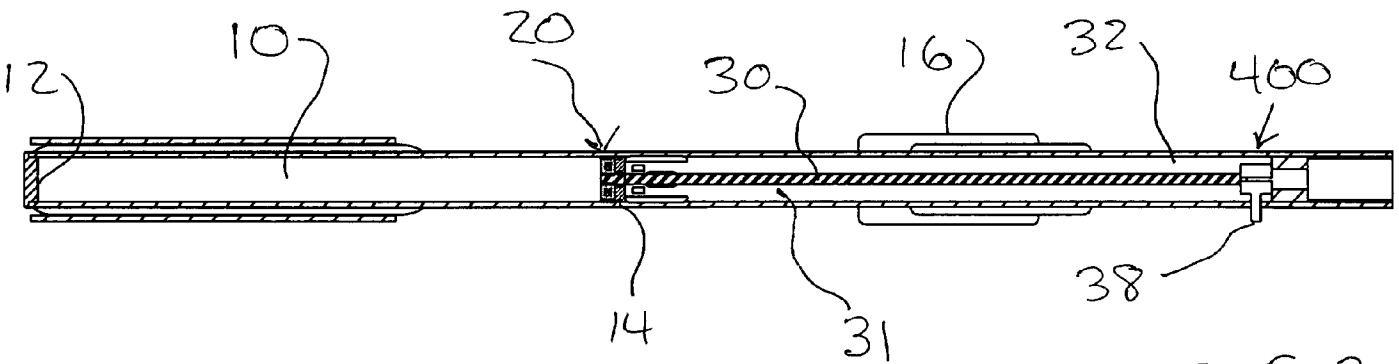
FIG. 2 shows a sectional top view of FIG. 1 detailing the placement of in-line piston, cylinder and bowstring draw attachment.
Figure 3:
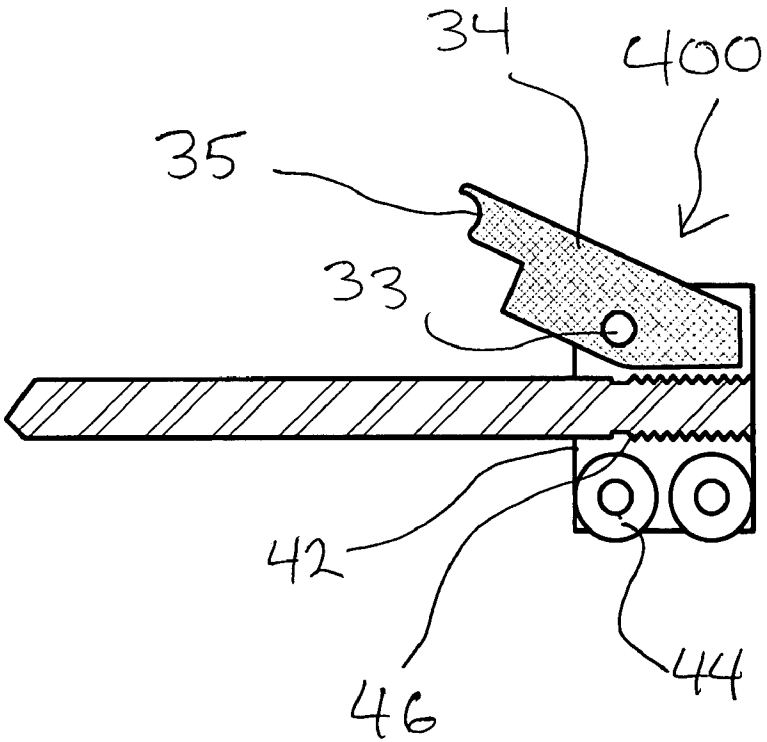
FIG. 3 shows a side view of the pneumatic piston and cylinder as well as string pick up arm assemblies, removed from the crossbow.
Figure 3:
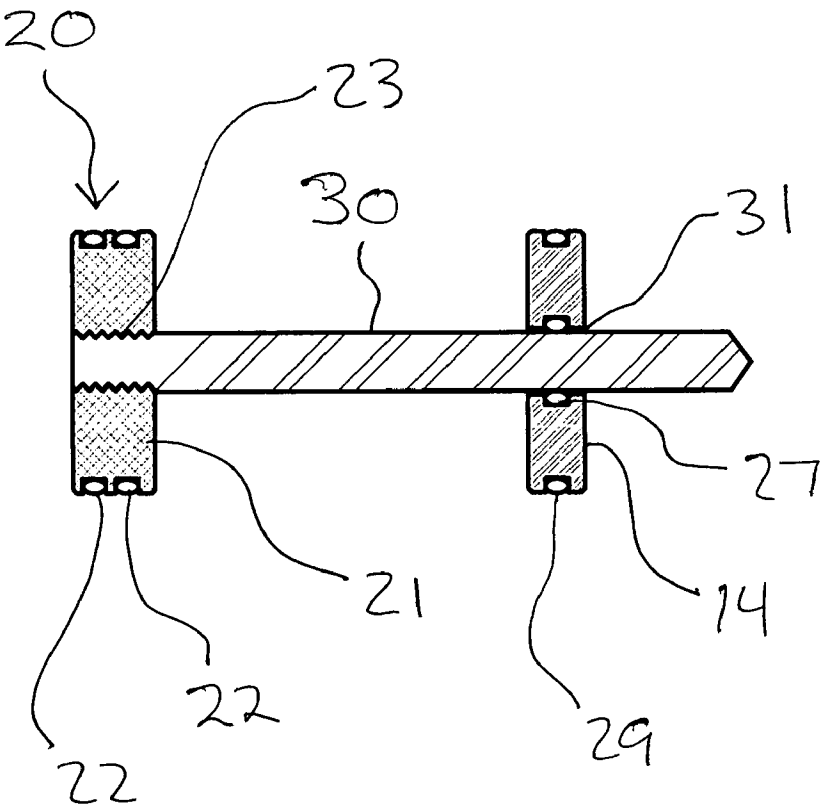

Most visible in FIG. 3 is the pick up arm assembly 400, removed from the crossbow. A closer look at pick up arm assembly 400 reveals a pivot at 33 that pick up arm 34 is allowed to at least partially rotate about. Biasing force $F_B$ illustrates that the pick up arm 34 is intended to protrude up and above the surface of flight track 37 (FIG. 1), protruding through the flight track fletching void 31 (FIG. 2) when no external forces are acting upon it. This way, string interface 35, located at the extreme end of string pick up arm 34 is able to contact bowstring for either a cocking or un-cocking operation. Side bolt 38 (FIG. 2) rigidly connects to the pick up frame 42 and extends slightly out of the stock 16 such that an archer is capable of manually moving the pick up arm assembly fore and aft without the need to use compressed gas. FIG. 2, top-view, illustrates the preferred side bolt placement.

Closer inspection of compressed gas cartridge dispenser 200, shown integrated into crossbow stock 16 (FIG. 1) details an already existing product. Dispenser 200 is manufactured by Innovations in Cycling, Inc. and is most commonly used to controllably inflate bicycle tires. Additionally, dispenser 200 is protected at least in part by U.S. Pat. No. 5,544,670, titled: Inflation device for an inflatable article of manufacture and adaptor therefor, filed Dec. 15, 1993 by Phillips et, al. as well as pending application Ser. No. 10/199,281, titled: Compressed gas cartridge dispensing system allowing interchangeable use of different capacity compressed gas cartridges and novel storage feature, filed Jul. 22, 2002 by Anthony S. Hollars of Tucson, Ariz. and pending application Ser. No. 10/199,286, titled: High pressure cartridge having a non-threaded neck diameter capable of fitting within a ⅜–24 female thread minor diameter with a 16 to 40 ml water capacity, filed Jul. 22, 2002 by Anthony S. Hollars of Tucson, Ariz.

Cartridge dispenser 200 typically dispenses compressed gas cartridges filled with inert carbon dioxide but other gases are equally dispensable. Additionally, the dispenser most commonly will dispense 12 and 16-gram non-threaded neck (smooth neck) cartridges as well as 12, 16, and 25-gram threaded neck cartridges. Other cartridge volumes are available but the afore-mentioned are most commonly used.

Near the center of the crossbow in FIG. 1 is retaining bowstring sear mechanism 300. Finger trigger 42 mechanically actuates the sear mechanism to fire the crossbow at the archer's discretion. Also in FIG. 1 is shown dispenser trigger 202 located on cartridge dispenser 200. The purpose of dispenser trigger 202 is for introducing compressed gas from dispenser 200 into pneumatic cylinder 10. Operation is as follows: compressed gas flows from dispenser 200, into plumbing 24. The opposite distal end of plumbing 24 fluidly connects to inlet 26 that plumbs to fore-most part of pneumatic cylinder 10, fore of piston assembly 20 and aft of forward end cap 14.

Figure 4:
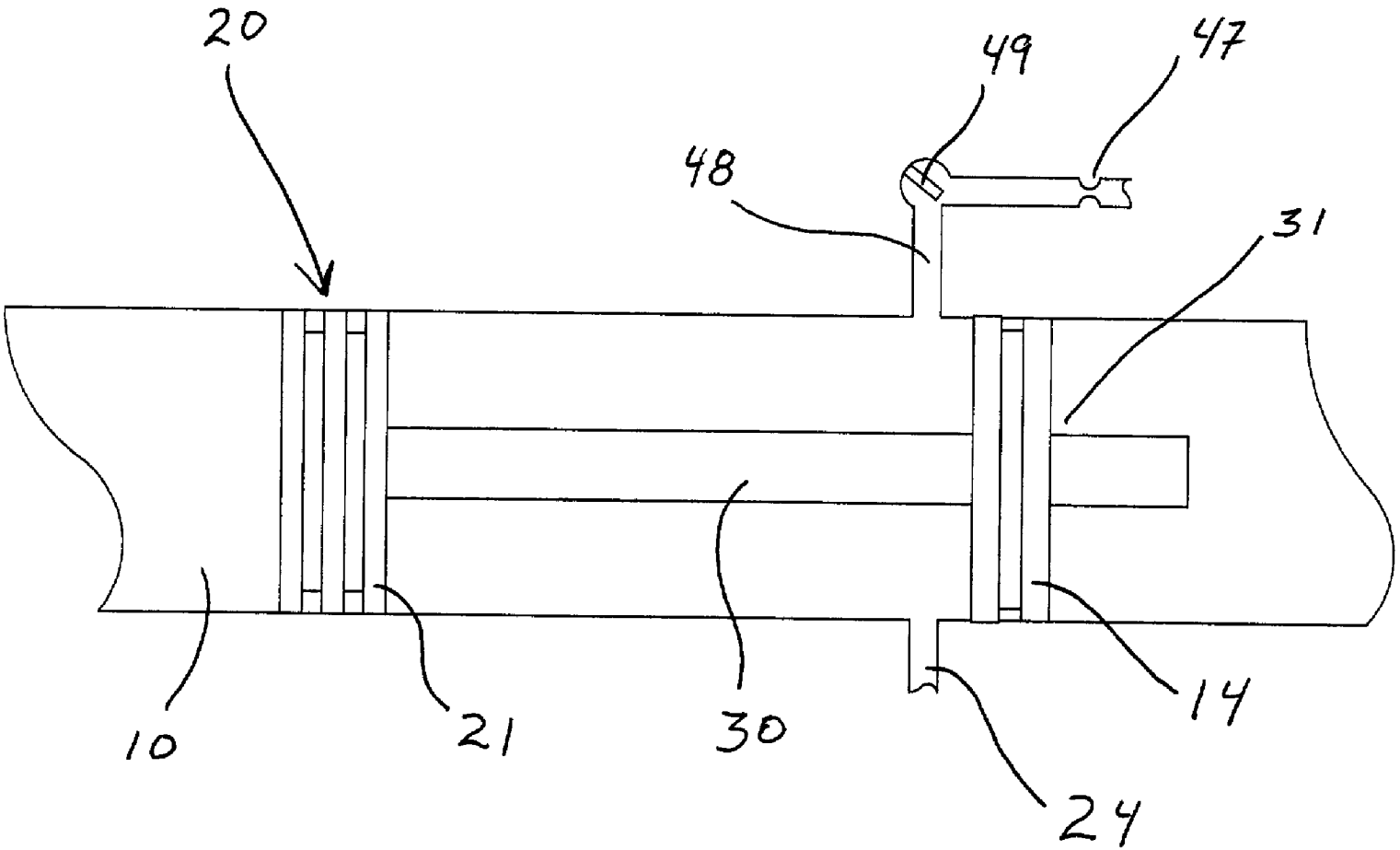
FIG. 4 shows a close-up side view of the piston and fore pneumatic cylinder seal as well as the gas inlet and gas outlet fluid connections to the pneumatic cylinder.

FIG. 4 shows a close-up view of the fluidly connected gas inlet 24. Additionally, fluid outlet 48 is shown located in the same vicinity as inlet 24. The vicinity being aft of the forward end cap 14 and fore of piston 21, even when piston 21 is at its forward most position. An archer is able to controllably dry-fire the crossbow in a controlled release manner by opening valve 49 located upstream from restrictive flow orifice 47. After the dry fire is completed, cocking action is accomplished by closing valve 49 and proceeding with dispensing the pressurized gas with the gas cartridge dispenser. No pressurized gas will escape through the restrictive flow orifice 47 and the increased cylinder pressure will cause piston 21 to operatively draw the bowstring.

I claim:

1. A crossbow comprising:

a compressed gas dispenser;

a pneumatic cylinder and piston assembly;

a string pick up arm capable of linear translation comprising a pivoted connection to pick up arm body such that said pick up arm is capable of engagement with said bowstring when pivoted upward as well as capable of sufficiently pivoting down such that said bowstring and said pick up arm do not engage;

said gas dispenser fluidly connected to said pneumatic cylinder;

said string pick up arm operatively connected to said piston such that translation of said pick up arm and piston caused by a pressure rise in said pneumatic cylinder by introduction of high pressure gas from said gas dispenser forces said piston to move in the cylinder as well as translate said connected string pick up arm drawing a bowstring a sufficient distance allowing said drawn bowstring into engagement with the firing sear mechanism.

2. Said crossbow from claim 1 in which said string pick up arm comprises an operatively connected grab handle of sufficient size such that an archer is capable of manual translation of said string pick up arm; the operatively connected string pick up arm to said piston allows manual positioning of the drawing assembly to a desired location.

3. Said crossbow from claim 1 further comprising a closable fluidly connected flow-rate restrictor located between said pneumatic cylinder and atmosphere such that upon dry-firing said crossbow, thereby loading said operatively connected string pick-up arm and said piston by the bowstring force, gas is released at a controlled rate to the atmosphere thus slowing bowstring let-off rate.

4. Said crossbow from claim 1 in which said string pick up arm is biased to said upward position.

5. Said crossbow from claim 4 in which said string pick up arm is operationally pivoted to said down position by an installed bolt physically touching thus pivoting said string pick up arm to said down position.

6. A pneumatic crossbow cocking device comprising:

a piston residing in a cylinder;

a connection shaft with distal ends connected to said piston and a string pick up frame;

said shaft passing through a pressure holding seal at the fore end of said cylinder;

said string pick up frame comprising a moveable string pick up arm, said arm biased to the position such that a bowstring contacts said arm;

said string pick up frame capable of at least one degree of freedom;

said biased arm capable of movement upon insertion of a bolt such that said arm will not interfere with said bolt;

a compressed gas dispenser fluidly connected to said cylinder, said fluid connection aft of said pressure holding seal and fore of said piston.

7. Said pneumatic crossbow cocking device from claim 6 further comprising a closable fluidly-connected flow-rate restrictor located between said pneumatic cylinder and atmosphere such that upon dry-firing said crossbow, thereby loading said operatively connected string pick-up arm and said piston by the bowstring force, gas is released at a controlled rate to the atmosphere thus slowing bowstring let-off rate.

8. Said pneumatic crossbow cocking device from claim 6 comprising an operatively connected string pick up frame grab handle of sufficient size such that an archer is capable of manual translation of said string pick up arm; the operatively connected string pick up arm to said piston allows manual positioning of the drawing assembly to a desired location.

* * * * *